US006926183B2

(12) United States Patent
Chang

(10) Patent No.: US 6,926,183 B2
(45) Date of Patent: Aug. 9, 2005

(54) SHOULDER-BORNE CARRYING STRAPS, CARRYING STRAP ASSEMBLIES AND GOLF BAGS INCORPORATING THE SAME

(75) Inventor: I-Teh Chang, Hong Kong (CN)

(73) Assignee: Danny Yim Hung Lui, Hong Kong (CN)

( * ) Notice: Subject to any disclaimer, the term of this patent is extended or adjusted under 35 U.S.C. 154(b) by 41 days.

(21) Appl. No.: 10/028,731

(22) Filed: Dec. 28, 2001

(65) Prior Publication Data

US 2003/0121942 A1 Jul. 3, 2003

(51) Int. Cl.[7] ..... A45F 3/04; A45F 3/12; A41F 15/02

(52) U.S. Cl. ..... 224/260; 224/264

(58) Field of Search ..... 224/257, 259, 224/260, 264, 627, 645, 579; D3/327

(56) References Cited

U.S. PATENT DOCUMENTS

| | | | | | |
|---|---|---|---|---|---|
| 2,808,873 | A | * | 10/1957 | Gobble | 224/257 |
| 3,799,413 | A | | 3/1974 | McBain | |
| D304,882 | S | * | 12/1989 | Kawaguchi | D3/327 |
| 4,976,388 | A | * | 12/1990 | Coontz | 224/264 |
| 5,240,159 | A | * | 8/1993 | Gregory | 224/209 |
| 5,292,044 | A | * | 3/1994 | Reimers | 224/264 |
| 5,390,788 | A | | 2/1995 | Schenkkan | |
| 5,765,735 | A | * | 6/1998 | Kimchi et al. | 224/264 |
| 5,979,727 | A | * | 11/1999 | Steuer | 224/645 |
| 6,006,974 | A | * | 12/1999 | Varney et al. | 224/645 |
| 6,045,019 | A | * | 4/2000 | Moses | 224/257 |
| 6,062,383 | A | | 5/2000 | Han | |
| 6,168,060 | B1 | * | 1/2001 | Mayers | 224/645 |
| 6,182,874 | B1 | * | 2/2001 | Feldman, Jr. | 224/259 |
| 6,457,620 | B1 | * | 10/2002 | Batten et al. | 224/645 |

FOREIGN PATENT DOCUMENTS

| | | | | |
|---|---|---|---|---|
| FR | 2582490 | A1 | * 12/1986 | 150/107 |

* cited by examiner

*Primary Examiner*—Sue A. Weaver
(74) *Attorney, Agent, or Firm*—Burns, Doane, Swecker & Mathis, LLP

(57) ABSTRACT

A dual strap carrying system including two non-symmetrical shoulder straps which are connectable to form a single strap carrying system. Each of the strap members preferably has shoulder engaging surfaces of the similar frictional shoulder characteristic so that a slippery shoulder engaging surface is provided on each of the strap members when the straps are configured as a dual strap carrying system and a non-slippery shoulder engaging surface is formed when the straps are configured as a single strap carrying system suitable for use for load such as bags or golf bags or the like.

20 Claims, 7 Drawing Sheets

RIGHT-SIDE STRAP

TOP VIEW

BOTTOM VIEW

TRAPEZIUS
MUSCLE
10
20
10

WEIGHT SHIFT

SHOULDER-BORNE CARRYING STRAPS, CARRYING STRAP ASSEMBLIES AND GOLF BAGS INCORPORATING THE SAME

FIELD OF THE INVENTION

The present invention relates to carrying straps, carrying strap assemblies, and, more particularly, to carrying straps with enhanced tension configuration. This invention also relates to a dual strap carrying assembly which can be converted into a single strap carrying assembly of a non-symmetrical design for carrying a load on either the left or the right shoulder of a carrying person. More specifically, although of course not solely limiting thereto, this invention also relates to carrying straps and carrying strap assemblies for golf-bags and other bags as well as golf bags provided with the same.

BACKGROUND OF THE INVENTION

Shoulder-borne carrying straps are generally provided for use with bags, sacks, rucksacks, boxes or containers to assist a person to carry bulky, heavy or both bulky and heavy articles or items from one place to another. Shoulder straps are preferred over hand-carrying straps because the weight can rest on the shoulder ridge of the carrying person, thereby freeing the hands of the carrying person for other purposes such as attaining body balance or for self protection.

The dual shoulder loop and the single shoulder loop carrying strap systems are the two common types of shoulder carrying systems. The single shoulder loop carrying strap system (hereinafter referred to as the "single strap" system for succinctness and convenience) generally includes a length of strap having both its longitudinal ends attached to the load, thereby forming a loop of a carrying strap. In use, a person inserts one of his arms through the loop until the shoulder-engaging portion of the strap rests on the shoulder ridge of the carrying person and then lifts the load by his shoulder. In such an application, the load is usually carried on one side of the body and the load is usually borne by either shoulder on that side of the carrying person, depending on personal preferences. A typical example of a single strap system is shown, for example, in U.S. Pat. No. 5,735,398 to Price.

Since a single strap carrying system is usually used to carry a load on one side of the carrying person, a well-designed shoulder strap usually includes a padded shoulder engaging portion having a larger width than the rest of the strap to distribute weight. In a typical well-designed carrying strap, the shoulder engaging portion is usually slightly curved or has an overall parabolic shape so that the portion of the strap between the load and the shoulder engaging portion can smoothly and gradually extend towards the outside of the body without propping up the outer edge of the shoulder engaging portion.

Thus, a typical single carrying strap is usually characterised by a length-wise non-symmetrical shoulder engaging portion which is designed to accommodate the transversal shape of the shoulder ridge for user comfort as well as to mitigate the tendency of the strap to slip off the shoulder due to the overhanging load.

Because of its non-symmetry, a single strap for a load having specific orientations such as golf bags is usually adapted for use on either the left- or the right-shoulders so that different straps are needed for the left- and the right-shoulders. Hence it will be advantageous to provide carrying straps with improved user friendliness such that the single straps can be used on either shoulders.

While the single strap system is convenient for moving a load for a short distance, it is not particularly preferable for moving a heavy load for a longer distance because the strap load is localised on one shoulder ridge and this may hurt the carrying person. This is particularly so when the load being carried is a fully-loaded golf bag having an open end with a lot of loosely placed golf clubs which may jiggle, jump or bounce when the carrying person moves.

To enhance the comfort of the carrying person, a dual shoulder-loop carrying system (hereinafter referred to as the "dual strap" system for succinctness and convenience) is usually utilized. The dual strap system generally includes two strap loops which are formed by attaching two loops of carrying straps to a load. The shoulder loops are generally designed so that the arms of the carrying person are inserted through the loops until the shoulder engaging portions on the two strap loops rest squarely on the shoulder ridges of the carrying person's. Furthermore, in the dual strap systems, the weight of the load is usually quite evenly distributed across the two shoulders and the load is usually maintained near the middle of the back of the carrying person.

Common examples of applications of a dual strap system includes back-packs, rucksacks, baby carriers and golf-bags. Examples of such dual strap systems which have been particularly utilized in golf bags include U.S. Pat. Nos. 5,042,704, 5,558,258 and 6,173,874 to Izzo, U.S. Pat. No. 5,954,255 to Beebe et al., U.S. Pat. No. 6,006,974 to Varney et al., and U.S. Pat. No. 6,173,874 to Stein et al.

While a dual strap system provides enhanced comfort due to a substantially balanced weight distribution on both shoulders, the harness-like structure of a dual strap system makes it more tedious to mount and more difficult to dismount than a single strap system. Dismounting a dual strap system is more difficult because the straps usually converge towards the load and, as a result, the tension in the straps tends to pull the straps towards each other while dismounting requires pushing of the strap pair away from each other in order to remove them from the shoulder ridges.

In order to avoid the tediousness and difficulty associated with the mounting and dismounting of a load, when using a dual strap system, many people prefer to use a single strap system for moving a load for a short distance, for example, when carrying a fully-load golf-bag between hits, and, to use a dual strap system when carrying the load for a long distance. To accommodate the different usages, some golfers carry both a dual strap and a single strap system in their golf set so that the carrying systems can be used alternatively.

Thus, it will be advantageous if there can be provided carrying straps or strap carrying systems which can be convertible between a dual strap system and a single strap system as and when necessary so that a user does not have to carry two different sets of carrying straps. It will be more advantageous if such a strap system can be easily and conveniently convertible between the two forms without compromising the comfortability of the dual strap system while at the same time even possibly enhancing the comfortability of the resultant single strap system. Furthermore, it will be further advantageous if there can be provided a dual strap carrying system of the afore-said describe which can be convertible into a non-symmetrical single strap system which is equally well adapted for use both on the left or the right shoulders.

Also, it will be highly advantages if there can be provided an improved carrying strap with improved characteristics to alleviate its tendency to slip off the shoulder.

However, there are several conflicting requirements which need to be overcome, or at least alleviated, in order to provide a strap carrying system having the aforesaid-advantages or benefits. For example, since the load carried by a dual strap system tends to pull the two strap members towards each other, there is generally no need to prevent un-intentional slipping off of the straps from the shoulders. As a result, the shoulder engaging portions of the two member straps usually include a non-frictional shoulder engaging surface so that the member straps can be easily pushed away from each other and from their respective contacting shoulder ridges for dismounting.

On the other hand, a load carried by a single strap system is usually disposed on one side of the body and tends to pull the shoulder engaging portion of the strap away from the body and towards a disengaging position. To alleviate undesirable slippage of the shoulder ridge, the shoulder engaging portion of the strap member is usually provided with a non-slippery or frictional shoulder engaging surface together with a non-symmetrical transversal shape along its length.

Hence, it will be desirable if there can be provided improved carrying straps or carrying strap assemblies which provide at least some of the aforesaid benefits or advantageous while overcoming, or at least accommodating, the afore-said conflicting requirements.

OBJECT OF THE INVENTION

In light of the above, it will be appreciated that there is a continuing and long-awaited need for improved carrying straps and carrying strap assemblies which substantially achieve the aforesaid benefits while fulfilling the afore-said conflicting requirements.

In particular, there exists a demand for an improved single carrying strap having improved tension characteristics to alleviate its tendency to slip off the shoulder.

Therefore, it is an object of the present invention to provide improved carrying straps which have improved tension configuration and characteristics to help the strap to stay on the shoulder ridge so that a user does not have to restore the strap frequently.

It is an object of the present invention to provide improved carrying straps which have improved tension configuration and characteristics to help the strap to stay on the shoulder ridge so that a user does not have to restore the strap frequently.

Accordingly, it is an object of the present invention to provide carrying straps or a strap carrying assembly which can be configured as a dual strap carrying system or, alternatively, as a single strap system without compromising their benefits.

It is another object of the present invention to provide carrying straps and strap carrying system which can be configured either as a dual strap carrying system or a single strap system having a non-symmetrical strap member which can be used on other sides of the shoulders of the carrying person.

As a minimum, it is an object of the present invention to provide the public with a choice of an improved carrying strap or a strap carrying system having improved tension characteristics. It is yet a further object of this invention to provide a strap assembly in which both the non-symmetric strap members of the dual strap system can be utilized to form part of the non-symmetrical single strap system so that both straps can be utilized effectively. It is at least an object of this invention to provide an improved carrying strap for the choice of the public.

SUMMARY OF THE INVENTION

In view of the afore-said, there is provided in one broad aspect of the present invention a carrying strap including a shoulder-engaging portion disposed between a first and a second longitudinal strap ends, said shoulder-engaging portion includes a strap length of a first curvature, wherein said shoulder-engaging portion is connected to each said longitudinal strap end via a curved strap portion of a second curvature, said second curvature being substantially opposite to said first curvature.

Preferably the shoulder-engaging portion includes a retracted portion for fitting between the neck and the shoulder edge of the carrying person.

Preferably, the shoulder-engaging portion includes a concave side of said first curvature extending intermediate between said longitudinal ends, the ends of said concave side are connected to said longitudinal ends respectively via the convex side of said strap portions of said second curvature.

Preferably, one side of the strap extending between said longitudinal ends include alternate protracted and retracted strap portions.

Preferably, the strap includes alternate shoulder engaging surfaces having dissimilar frictional characteristics.

Preferably, the shoulder strap portion generally forms a rounded W-shape between said longitudinal ends.

Preferably, the strap includes a plurality of strap portions resembling the shape of a boomerang.

Preferably, the shoulder strap portion includes two boomerang-shape portions connected in series.

In another broad aspect of the present invention, there is provided a carrying strap including a shoulder-engaging portion disposed between a first and a second longitudinal strap ends, said shoulder-engaging portion includes a retracted portion, wherein a first and a second strap portions of similar curvature are disposed respectively between said shoulder engaging portion and said first and second longitudinal ends.

In order to enhance comfortability of single strap carrying system obtained from conversion of a dual strap system, it is preferred that the single strap carrying system includes the back-to-back fastening of strap members of the dual strap carrying system so that a doubly cushioned single strap system can be formed to enhance comfortability and, at the same time, none of the strap members of the dual strap system has to be stored when converted into the single strap system.

According to another aspect of the present invention, there is provided a carrying strap assembly including a first and a second elongated strap members which are connectable to a load via detachable connecting means, said strap members have a first set of shoulder engaging surfaces for engaging the left and right shoulders of a carrying person when said straps are configured as a dual shoulder-loop carrying strap system, wherein each said shoulder engaging surface is non-symmetrical about its longitudinal center line and said first set of shoulder engaging surfaces are substantially mirror symmetrical to each other and said shoulder engaging surfaces are detachably fastenable to each other so that both shoulder engaging surfaces are substantially mutually overlapping.

Preferably, the first and said second strap members are connectable near the ends by a detachable connecting means.

BRIEF DESCRIPTION OF THE DRAWINGS

Preferred embodiments of the present invention will now be explained in further detail by way of example and with reference to the accompanying drawings, in which.

DETAILED DESCRIPTION OF THE PREFERRED EMBODIMENTS

Figure 1:
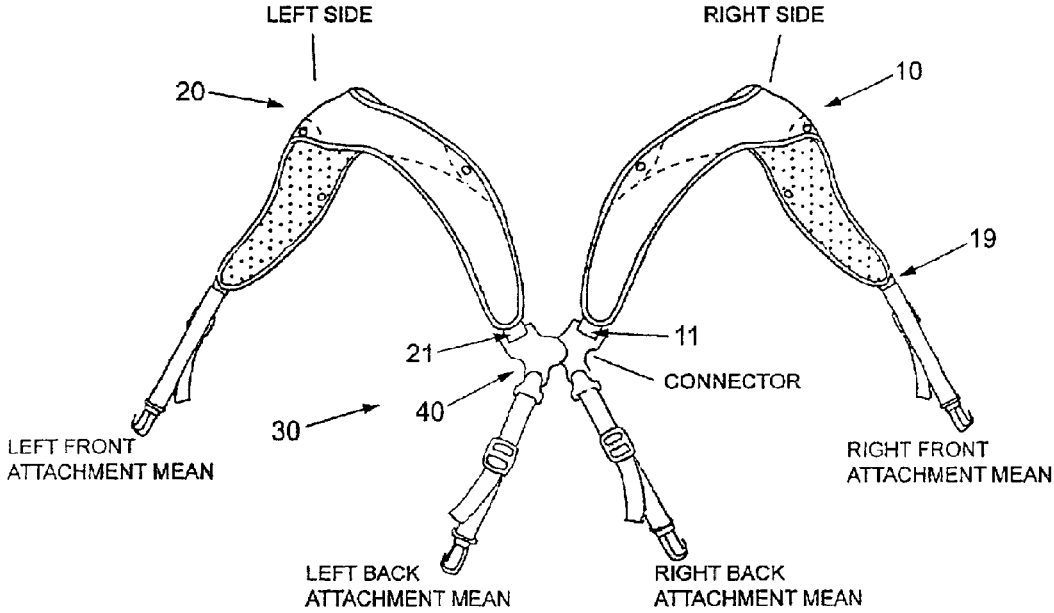
FIG. 1 shows an example of a dual strap carrying system formed by an assembly of a left and a right strap members.

Referring firstly to the Figures, especially FIGS. 1 and 9.*a,* there are shown strap members (10, 20) of a first embodiment of the present invention which are assembled and configured as a dual strap carrying system (30) or assembly of a second embodiment of the present invention. The dual strap carrying system (30) includes a first (10) and a second (20) strap members which are assembled together and configured as a dual strap carrying system by connecting their corresponding longitudinal ends (11, 21) to the load, for example, a golf bag, via a swivel connector (40) for further enhanced comfort. Each of the strap members is generally a shoulder strap having two ends for attaching to a load and the straps are designed so that they can be used as a stand-alone carrying strap as and when required. At the same time, both straps can be assembled to form a combined single strap in a manner to be explained in further details below.

Figure 2:
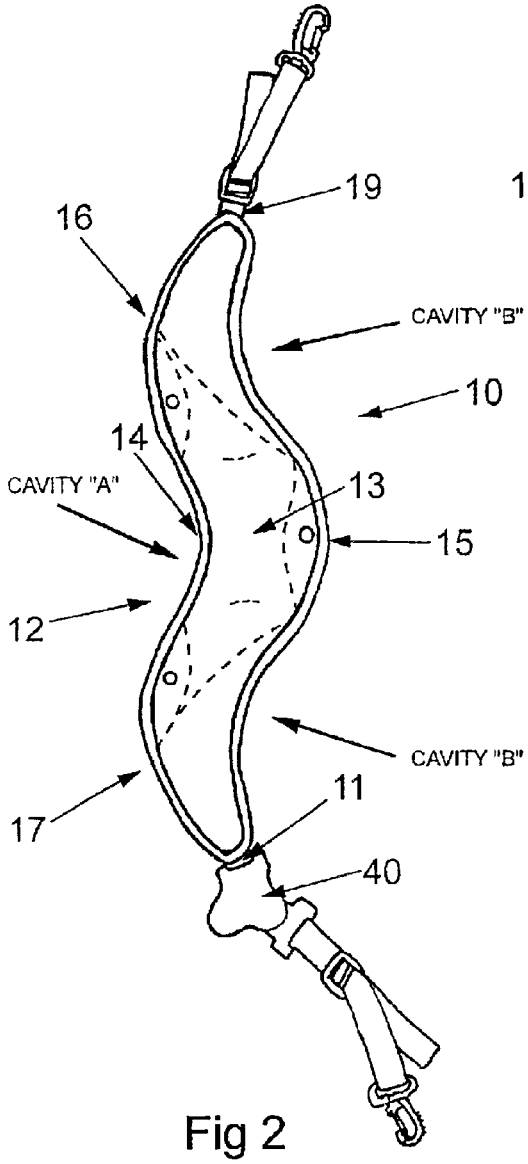
FIG. 2 shows the top plan view of the left strap member and having the non-slippery shoulder engaging surface for exposed.
Figure 3:
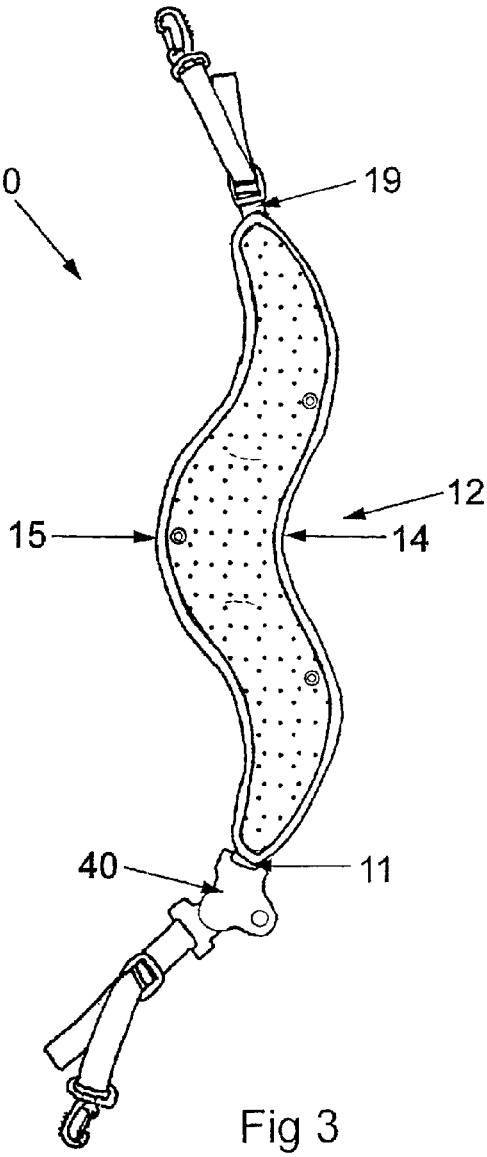
FIG. 3 shows the bottom view of the left side strap member of FIG. 2 with the slippery shoulder engaging surface fully exposed.

Referring to FIGS. 2 and 3, there are shown the top and bottom plan views of the first strap member which are delineated by two substantially elongated and rounded W-shape edges on its lateral sides. The first strap member (10) of FIG. 2 includes a shoulder engaging portion (12) having a first shoulder engaging surface (13) which is defined between a concave peripheral side (14) and a convex (15) peripheral side. The shoulder engaging portion (12) is connected to both longitudinal ends (11, 19) of the carrying strap (10) via two intermediate strap portions (16, 17). Each intermediate strap portion includes a convex lateral side which joins to the concave side of the shoulder-engaging portion.

An alternative second shoulder-engaging portion (18) is disposed on the back of the first engaging surface (13). It is preferred that the two alternative surfaces have dissimilar shoulder engaging characteristics for applications to be described below. In this embodiment, it is preferred that the first engaging surface (13) is substantially frictional or non-slippery.

The shoulder-engaging portion (12) is connected to the other adjacent intermediate strap portions with the longitudinal ends of its concave portion connecting to the convex portions of the adjacent strap portions and with the longitudinal ends of its convex portion connecting to the concave portions of the adjacent strap portions.

As shown more specifically in FIGS. 2 and 3, it will be observed that the convex side of the curved shoulder-engaging portion connects with the concave sides of the adjacent intermediate connecting strap portions while, at the same time, the concave side of the shoulder-engaging portion connects with the convex side of the adjacent intermediate connecting strap portions.

In other words, the strap member (10) includes a shoulder-engaging portion having a curvature which is connected to adjacent intermediate strap portions having a substantially opposite curvature. With this arrangement, the strap member (10) of this specific design has a substantially rounded W-shape between its longitudinal ends. Alternatively, this strap member (10) can be described as including a retracted portion for resting between the neck and the arm of the carrying person and that retracted portion is disposed intermediate between two adjacent protruding portions.

Referring now to FIGS. 8, 10, 11 and 12, there are shown examples of how this strap member (10) can be used a single strap carrying system. It will be observed that, when the strap member is used as a single strap carrying system, the load overhangs the side of the body of the carrying person. In such a use, the shoulder-engaging surface (13) rests on the shoulder ridge of the carrying person and the adjacent strap portions will respectively overhang on the front and rear parts of the person.

Due to the curvatures of the shoulder-engaging portion (14) and the adjacent connecting strap portions, the front and rear overhanging portions of the strap member form a curvature overhanging the front and rear part of the body. This curvature resembles the shape of a boomerang with the first (upper) limb adjoining the shoulder-engaging portion (12) extending towards the body of the carrying person and the second, lower or distal, limb extending away from the body and towards the load as shown in the Figures.

When a load is attached to the longitudinal strap ends (11, 19) and overhangs the right side of the carrying person, the gravitational weight of the load causes the strap members to be taut and pulls the intermediate strap portions downward. Due to the curvature of the intermediate strap portion, downward tension on the lower-half (lower or distal limb) of the intermediate strap portion causes resultant inward tension in the upper-half (first limb) of the intermediate strap portion which will pull the shoulder-engaging portion (12) towards the neck of the carrying person, thereby substantially mitigating or counter balancing the tendency to slip off the shoulder.

To further mitigate the tendency to slip off the shoulder, the shoulder-engaging surface is preferably provided with a non-slippery surface, for example, by adding a frictional layer of a matted or meshed surface to enhance engagement between the loaded strap and the shoulder.

Figure 11:
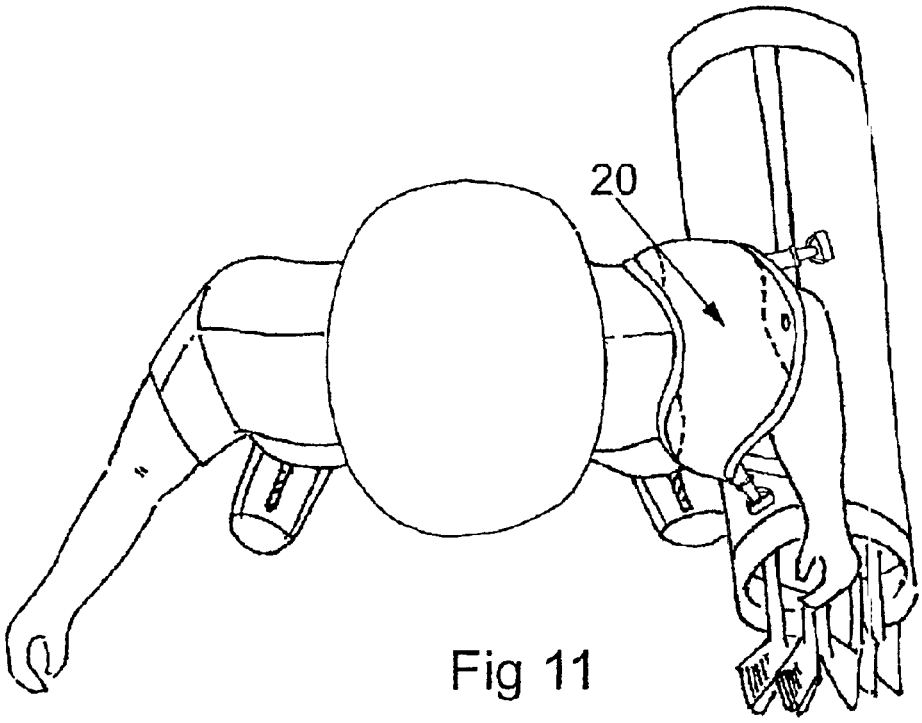
FIG. 11 shows the spatial relationship between the cushioned shoulder engaging portion of the strap member and the shoulder ridge of the carrying person when the strap is gripping on the left shoulder.
Figure 12:
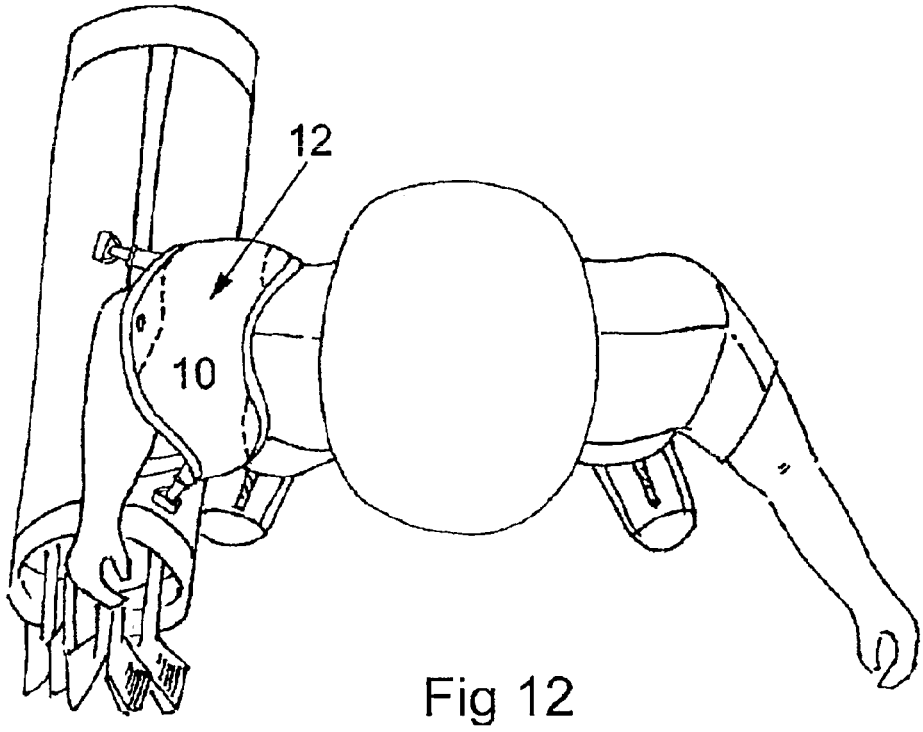
FIG. 12 shows a carrying person carrying a golf bag using a single strap system on the right shoulder of the carrying person.

Referring to FIGS. 11 and 12, it can be seen that the shoulder-engaging portion of the single strap member is worn so that its concave lateral side (14) juxtaposes the neck so that the concave portion substantially follows the shape of the trapezius muscle for the carrying person's comfort. To further enhance the carrying person's comfort, a cushioning pad (shown within the broken lines) is included in the shoulder-engaging portion. In addition, the shoulder-engaging portion may include a resilient or elastomeric substance embedded between the two alternative shoulder-engaging surfaces for further comfort.

In order to provide a strap member of a similar design for use as a carrying strap on the left shoulder, there is provided a second strap member which has a general mirror symmetry to that of the first, or right-shoulder, strap member. In general, the second strap member (20) also includes a shoulder engaging portion having a first shoulder engaging surface which is defined between a concave peripheral side and a convex peripheral side. The shoulder engaging portion is connected to both longitudinal ends of the carrying strap via two intermediate strap portions. Each intermediate strap portion includes a convex lateral side which joins the concave side of the shoulder-engaging portion. Similarly, the strap member can be described as including a shoulder-engaging portion having a curvature which is connected to adjacent strap portions having a substantially opposite curvature. With this arrangement, the strap member of this specific design has a substantially rounded W-shape between its longitudinal ends.

In order to provide a universal strap for both shoulders, the strap member is designed so that the intermediate connecting portions are substantially symmetrical about the center portion of the shoulder-engaging portion. With such an arrangement, the shoulder strap can be rotated 180 degrees about its longitudinal center and become a shoulder strap for the other shoulder and used in a manner as shown in FIG. 12.

It will be appreciated that while a retracted portion to accommodate the contour of the trapezius muscle is desirable for enhanced comfort, such a retraction is not strictly necessary. Improved tension characteristics to help a single strap to stay on the shoulder will be accomplished by providing curved intermediate portions between the shoulder engaging portion and the longitudinal ends such that the intermediate portions have a convexly curved portion which convexes towards the center of the body and away from the carrying side of the body during normal use.

Figure 4:
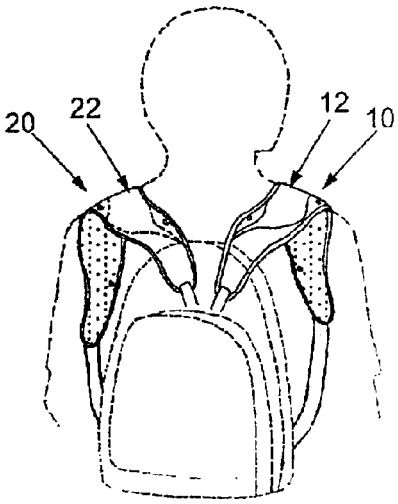
FIG. 4 shows, for example, an application of the dual strap carrying system.

In FIG. 4, a left- and a right-strap members are shown to be used together with their longitudinal ends attached to a load to form a dual strap system. With this configuration, the load can be shared between the two shoulders and the carrying person's comfort will be enhanced.

Figure 5:
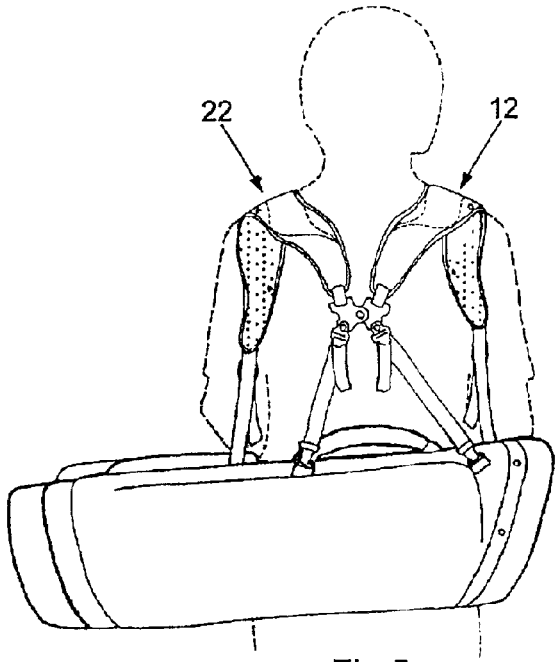
FIG. 5 shows another example illustrating the use of the dual strap carrying system.

FIG. 5 shows another example of a dual strap assembly in which the corresponding longitudinal ends (11, 21) of the left- and right-straps, i.e., the longitudinal ends overhanging the rear part of the carrying person, are connected firstly to a swivel connector and then to the load. This swivel connector serves to enhance the comfort of the carrying person by making differential weight adjustment as explained, for example, in the co-pending patent application Ser. No. 09/756,709. In this arrangement, the corresponding longitudinal ends of the left- and right-strap members are detachably attached to each other by the detachable members of the swivel connector (40).

Figures 6, 8:
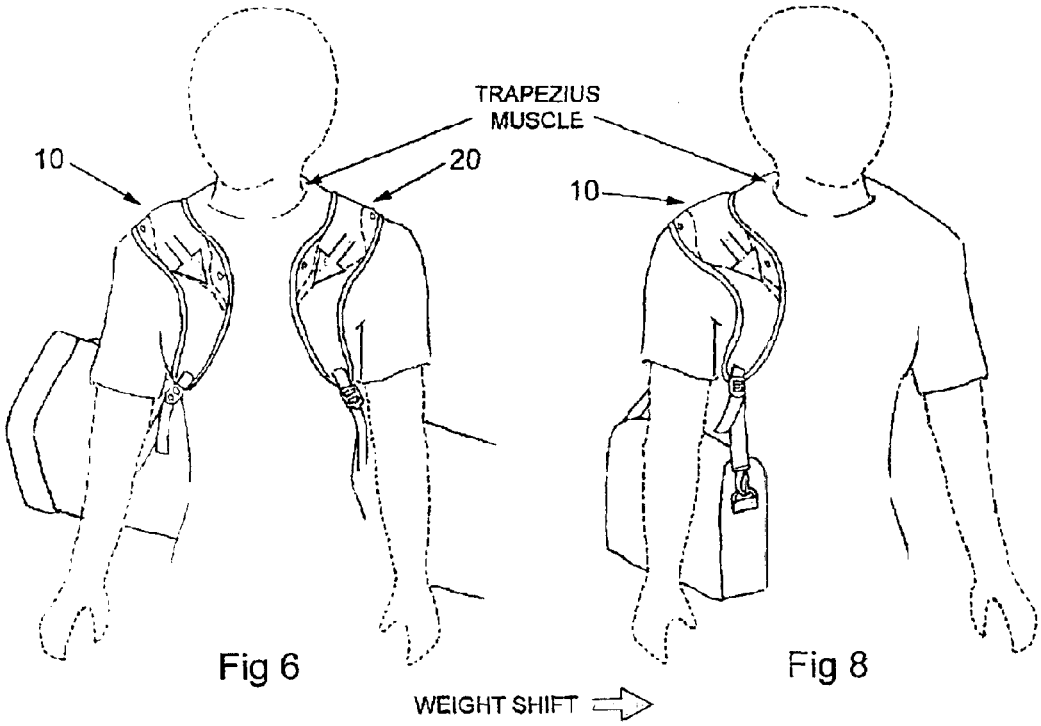
FIG. 6 illustrates schematically the directions and description of force within the dual strap systems.
FIG. 8 illustrates schematically the direction of force along a single strap system, FIGS. 9.*a* to 9.*e* illustrate the exemplary steps for converting a dual strap system into a single strap system by separating the strap members and recombining the non-symmetrical strap members into a single strap carrying system, FIG. 10 schematically illustrates a carrying person carrying a golf bag on one side of his body using the single strap system.

When used as a dual strap assembly as shown in FIGS. 5 and 6, the arrows shown in FIG. 6 indicate the direction of the tension on the straps when attached to a load. It will be observed that the weight of the load will cause the upper portion of the strap members, which are disposed immediately adjacent the shoulder-engaging portions (12, 22), to pull towards each other.

Figure 7:
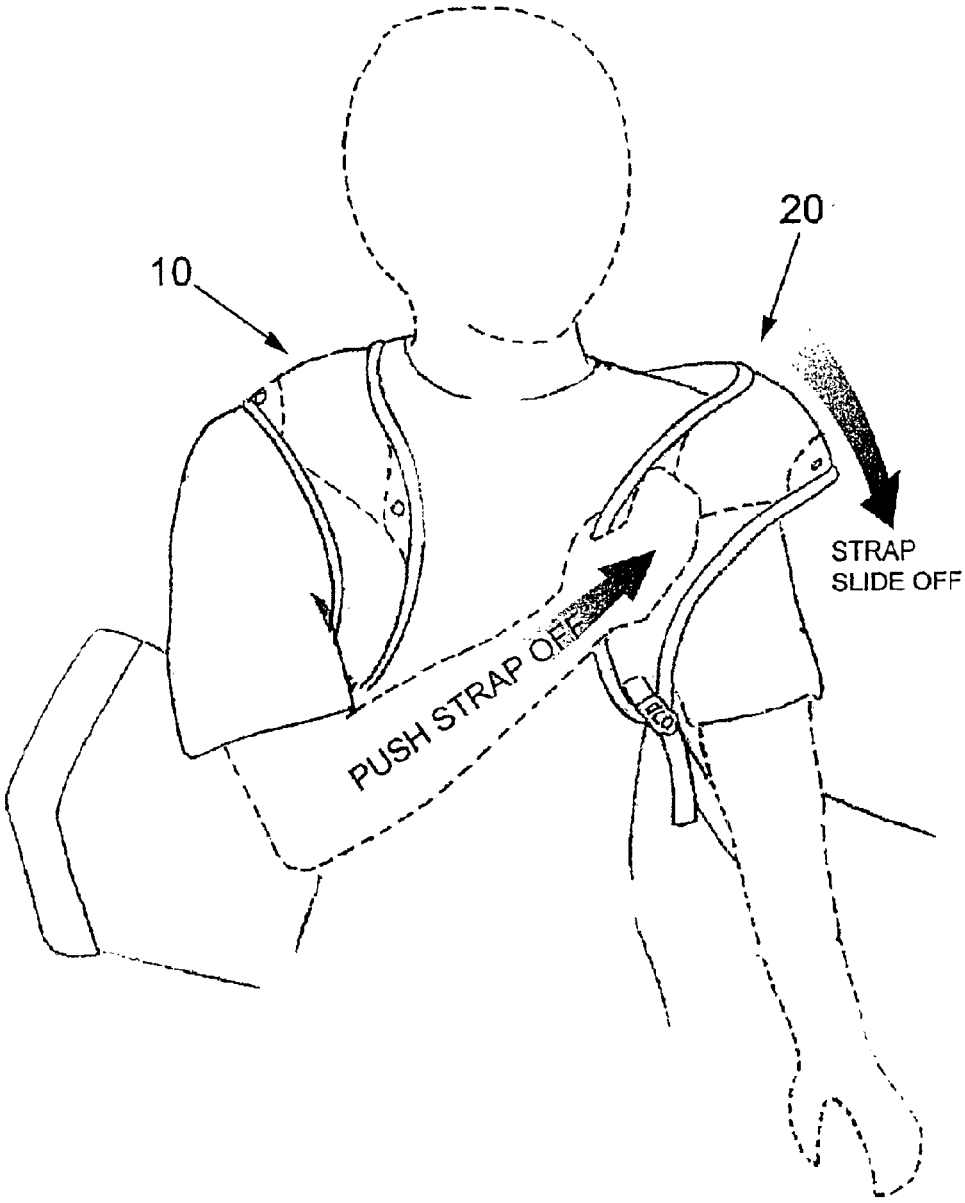
FIG. 7 illustrates schematically a carrying person dismounting the dual strap carrying system.
Figure 9A:
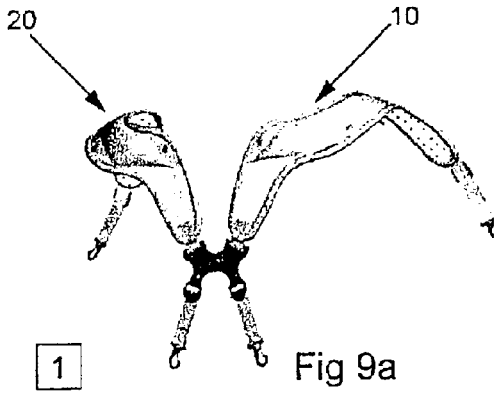
Figure 9B:
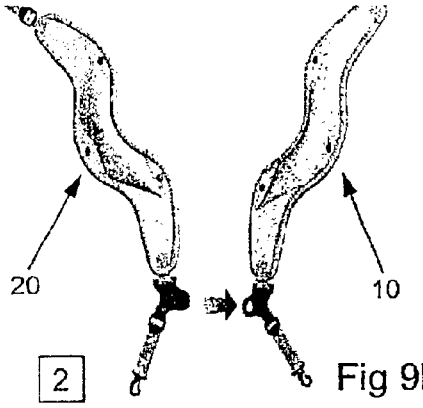
Figure 9C:
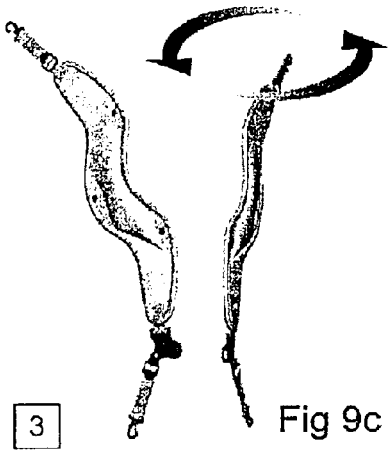
Figure 9D:
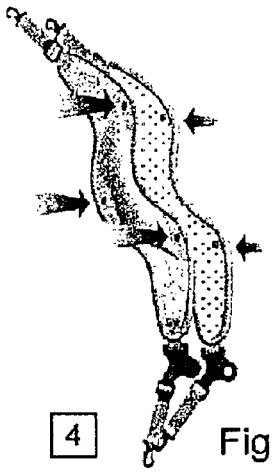
Figure 9E:
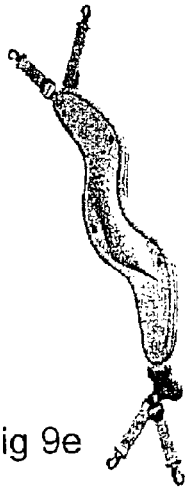
Figure 10:
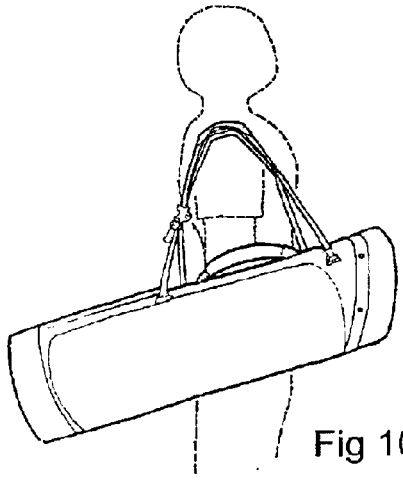

In this configuration, due to the convergence of the strap tensions on the upper part of the carrying strap portions, there is only minimal concern that the strap members will slip off the shoulders. In order to enable easy dismounting of the dual strap carrying system, it is preferred that the shoulder-engaging surfaces are made with a slippery or non-frictional surface so that it can be easily slid off the shoulder as and when desired by the user, as illustrated in FIG. 7.

Referring to FIGS. 9.*a*–9.*e,* there are shown the various steps of separating the dual strap assembly and combining the left and right strap members together to form a single strap carrying system comprising the two strap members. The strap members (10, 20) are fastened together by fastening means distributed on the slippery surface of each strap member. Thus, the combined single strap member will have non-slippery surfaces on both sides. It will be observed from FIGS. 9.*a* to 9.*e* that the two strap members are substantially of mirror symmetry to each other. At the same time, the upper and the lower portions of each strap member are substantially symmetrical to each other about the middle of the respective shoulder-engaging portions. In addition, the fastening means may be distributed on the slippery surface of the strap members in a substantially mirror-symmetrical way so that when the straps are combined, they will overlap with each other. The assembly of a single strap carrying system by combining two shoulder member straps provides a single strap system of enhanced comfort because of increased thickness. Furthermore, because of the symmetry, each of the member strap as well as the combined single strap assembly can be used either on the left or the right shoulder so that there is no need to carry a strap member as a load.

In the above specification, while examples of strap members and assemblies of strap members have been described with references to the drawings with accompanying illustrations of the usage and application, it should be appreciated that these examples are provided to assist understanding and illustration of the present invention only and should not be construed as intending to restrict the scope or application of the present invention.

As a minimum, it shall be appreciated that trivial modifications or variations made on the basis of the embodiments described in the present specification in light of common general knowledge are within the scope and spirit of the present invention.

Furthermore, it should be appreciated that the scope of the present invention should not be limited to the literal meaning of the claims but, instead, should be construed according to the essence and spirit of the invention as described and interpreted in accordance with the present specification.

In addition, the term curvature has been used in the present specification to describe an out-line which is non-linear and which substantially follows the shape of a conventional rounded curve. However, this is not restricted to a rounded curve and will include a portion which has an overall retracted or protruding outline which may, for example, be generally formed by an ensemble of straight or curved lines into an overall curved shape.

What is claimed is:

1. A carrying strap including a shoulder-engaging portion, a first strap portion and a second strap portion, said shoulder-engaging portion extending along the general longitudinal direction of said strap and being intermediate of said first and second strap portions, each of said first and second strap portions including a proximal section and a distal section, said proximal section being intermediate of said shoulder-engaging portion and said distal portion, a corresponding pair of adjacent proximal and distal sections being joined together with a first curvature, the proximal sections of said first and said second strap portions and said shoulder portion being joined together with a second curvature, said second curvature being substantially opposite to said first curvature, said proximal and said distal sections of said first and said second strap portions being configured so that, when used as a shoulder carrying strap for carrying a load, said proximal and distal sections respectively direct weight of said load towards and away from the body centerline of the person carrying said load.

2. A carrying strap according to claim 1, wherein said proximal sections of said first and said second strap portions extend from said shoulder-engaging portion generally along a direction which is away from said general longitudinal direction of said strap, and said distal sections extend from said proximal section along a direction which is generally towards said longitudinal direction of said strap, said shoulder-engaging portion comprising a curved portion which is adapted to follow the trapezius muscle of a user, the curvature of said curved portion of said shoulder engaging portion being substantially opposite to the curvature between a corresponding pair of said proximal and distal sections.

3. A carrying strap according to claim 1, wherein said proximal sections of said first and second strap portions extend away from said general longitudinal direction and said distal sections extend along a direction which is generally an inflexion to the direction of extension of said proximal sections.

4. A carrying strap according to claim 3, wherein a recess is present between said shoulder-engaging portion and said proximal sections, said recess being adapted for negotiating the trapezius muscle of the person carrying said load and having a curvature which is generally opposite to the curvature between an adjacent pair of said proximal and distal portions.

5. A carrying strap according to claim 4, wherein said shoulder-engaging portion includes a smooth shoulder-engaging surface and a frictional shoulder-engaging surface which are adapted for reversible use so that, when said strap is reversibly used, the weight directing characteristics of said proximal and distal sections of said first and second strap portions are maintained by also reversing the front and rear relationship of said first and second strap portions in relation to the person carrying said load.

6. A carrying strap according to claim 3, wherein said shoulder-engaging portion and said first and second strap portions in their entirety are generally W-shaped, the central recessed portion of said generally W-shaped strap configuration being adapted for negotiating the trapezius muscle of said load carrying person.

7. A carrying strap according to claim 1, wherein said shoulder-engaging portion includes a concave portion and is adapted for reversible use, said shoulder-engaging portion further including first and second alternative shoulder-engaging surfaces, such that when said carrying strap is used in the reverse form, said weight directing properties of said first and second portions are maintained by reversing the front and rear relationship of said first and second portions relative to the weight carrying person so that, during normal use, said shoulder-engaging portion is urged towards the neck of said weight carrying person regardless of the shoulder-engaging surface that is in contact with said person.

8. A carrying strap according to claim 7, wherein said first and second alternative shoulder-engaging surfaces have substantially dissimilar frictional characteristics, said shoulder-engaging portion having a cushioning pad shaped to follow the contour of the trapezius muscle.

9. A golf bag including a carrying strap of claim 7.

10. A carrying strap according to claim 1, wherein said first strap portion, said second strap portion and said shoulder-engaging portion together are substantially W-shaped.

11. A golf bag including a carrying strap of claim 10.

12. A carrying strap according to claim 1, wherein said first strap portion, second strap portion and said shoulder-engaging portion resemble two boomerangs connected together lengthwisely.

13. A carrying strap according to claim 12, wherein the carrying strap portions comprising said first strap portion, said second strap portion and said shoulder-engaging portion are substantially symmetrical about the center of said shoulder-engaging portion.

14. A dual strap shoulder-carrying assembly comprising first and second carrying straps of claim 1, and further including fastening means provided between distal sections of said first and second strap portions of said first and second carrying straps for converting said dual strap shoulder-carrying assembly into a carrying strap of claim 1.

15. A golf bag including a dual strap shoulder-carrying assembly of claim 14.

16. A golf bag including a carrying strap of claim 1.

17. A dual strap shoulder-carrying assembly, comprising first and second carrying straps, each of said first and second carrying straps including a shoulder-engaging portion, a first strap portion and a second strap portion, said shoulder-engaging portion extending along the general longitudinal direction of said strap and being intermediate of said first and second strap portions, each of said first and second strap portions including a proximal section and a distal section, said proximal section being intermediate of said shoulder-engaging portion and said distal portion, said proximal and said distal sections of said first and said second strap portions being configured so that, when used as a shoulder carrying strap for carrying a load, said proximal and distal sections respectively direct weight of said load towards and away from the body centerline of the person carrying said load, and fastening means provided between distal sections of said first and second strap portions of said first and second carrying straps for converting said dual strap shoulder-carrying assembly into a single carrying strap, wherein each said first and second carrying straps includes a reversible shoulder-engaging portion having a smooth shoulder-engaging surface and a frictional shoulder-engaging surface, said fastening means being disposed on said smooth shoulder-engaging surfaces so that the converted shoulder-carrying strap comprises two reversible and alternative shoulder-engaging surfaces which are substantially frictional.

18. A golf bag including a dual strap shoulder-carrying assembly of claim 17.

19. A carrying strap including a shoulder-engaging portion disposed between a first and a second longitudinal strap ends, said shoulder-engaging portion including a strap length of a first curvature, wherein said shoulder-engaging portion is connected to each said longitudinal strap end via a curved strap portion of a second curvature, said second curvature being substantially opposite to said first curvature, said strap including alternate shoulder engaging surfaces having dissimilar frictional characteristics, said alternate shoulder engaging surfaces including a slippery surface and an alternate non-slippery shoulder engaging surface, said slippery surface being used for shoulder engaging when said carrying strap is used as a strap member in a dual strap carrying system.

20. A carrying strap according to claim 19, further including fastening means for coupling with fastening means disposed on the slippery alternative shoulder engaging surface of a counterpart carrying strap member of a dual strap carrying system.

* * * * *